US007650663B2

(12) United States Patent
Michaels et al.

(10) Patent No.: US 7,650,663 B2
(45) Date of Patent: Jan. 26, 2010

(54) REPLACEABLE/DISPOSABLE BRUSH HEAD

(75) Inventors: Kenneth W. Michaels, Spring Grove, IL (US); Mark J. Skorski, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 597 days.

(21) Appl. No.: 10/975,603

(22) Filed: Oct. 28, 2004

(65) Prior Publication Data

US 2005/0108843 A1 May 26, 2005

Related U.S. Application Data

(60) Provisional application No. 60/517,944, filed on Nov. 6, 2003.

(51) Int. Cl.
*A47K 11/10* (2006.01)

(52) U.S. Cl. ..... 15/210.1; 15/209.1

(58) Field of Classification Search ..... 15/208, 15/209.1, 210.1, 228, 223; 428/132, 133
See application file for complete search history.

(56) References Cited

U.S. PATENT DOCUMENTS

| | | | | |
|---|---|---|---|---|
| 245,585 | A | 8/1881 | Tracy | |
| 1,631,791 | A | 6/1927 | Buckley | |
| 1,786,513 | A | 12/1930 | Zuckerman | |
| 1,993,215 | A * | 3/1935 | Hoyt et al. | 300/21 |
| 2,428,306 | A * | 9/1947 | Beagle | 15/146 |
| 2,514,496 | A * | 7/1950 | Jones et al. | 15/223 |
| 2,755,497 | A | 7/1956 | Greacen, Jr. | |
| 4,031,673 | A | 6/1977 | Hagelberg | |
| 4,523,347 | A | 6/1985 | Tames | 15/104.94 |
| 4,987,634 | A | 1/1991 | Weihrauch | |
| 5,218,733 | A | 6/1993 | Leu | 15/146 |
| 5,630,243 | A | 5/1997 | Federico et al. | |
| 6,012,643 | A | 1/2000 | Barlow et al. | |
| 6,037,036 | A * | 3/2000 | Febel | 428/132 |
| 6,094,771 | A | 8/2000 | Egolf et al. | |
| 6,557,778 | B1 | 5/2003 | Shiffler | |
| 6,745,427 | B1 | 6/2004 | Trenz et al. | |
| 7,159,265 | B2 * | 1/2007 | Soller et al. | 15/104.94 |

FOREIGN PATENT DOCUMENTS

| | | |
|---|---|---|
| EP | 0313495 A1 | 4/1989 |
| EP | 0759283 A1 | 2/1997 |
| EP | 1238604 A2 | 9/2002 |

(Continued)

OTHER PUBLICATIONS

Patent Abstracts of Japan vol. 1998, No. 01,Jan. 30, 1998 & JP 09228352D (Nodatsulcu KK), Sep. 2, 1997 abstract.

(Continued)

*Primary Examiner*—Laura C Guidotti

(57) ABSTRACT

Disclosed is a brush head useful for cleaning toilet bowls and for other cleaning applications. The brush head is flushable after use and insertable in a permanent type wand. The brush head may be a stack of sheets of water-dissolvable material. The sheets are compressed to bind them together into a stack. Surface indentations and piercing of layers at the indentations are used to bind the brush head layers together more securely without the need for binding adhesives, and to facilitate clamping.

3 Claims, 5 Drawing Sheets

FOREIGN PATENT DOCUMENTS

| | | | |
|---|---|---|---|
| GB | 886285 | | 1/1962 |
| GB | 2329325 | B | 9/2001 |
| JP | 10-295610 | A2 | 11/1998 |
| WO | WO 01/15587 | A1 | 3/2001 |
| WO | WO 01/72121 | A2 | 10/2001 |

OTHER PUBLICATIONS

Patent Abstracts of Japan vol. 2002, No. 03, Apr. 3, 2002 & JP 2001314362A (Minamii lsao), Nov. 13, 2001 abstract.

* cited by examiner

REPLACEABLE/DISPOSABLE BRUSH HEAD

CROSS-REFERENCE TO RELATED APPLICATIONS

This application is related to, and claims the priority benefit of, U.S. Provisional Patent Application No. 60/517,944, filed Nov. 6, 2003.

STATEMENT REGARDING FEDERALLY SPONSORED RESEARCH

Not applicable

FIELD OF THE INVENTION

The present invention relates to brushes that are used for cleaning. It appears particularly well suited for providing replacement brush heads for use with toilet brushes and other cleaning implements which have a handle that holds a replaceable head.

BACKGROUND OF THE INVENTION

Toilet brushes are typically used to swirl cleaning chemicals around a toilet bowl and then to scrub the sides of the bowl with those chemicals and water, so as to assist in removing stains along the bowl sides. Such brushes usually have brush bristles that are permanently affixed to the handle of the brush.

After using such brushes a consumer will typically attempt to rinse off the brush by swirling it in the bowl water. This rinsing process may be repeated through one or more additional rinsing flushes. While this may rinse off most of the cleaning chemicals, feces, urine, and stray bits of paper typically found in the toilet, the brushes still normally retain some contaminants even after extensive rinsing. As a result, such brushes can develop an unpleasant smell or appearance during storage.

Regardless, such brushes will be dripping wet immediately after use. The consumer sometimes will therefore shake the brush over the toilet to try to remove most of the excess water, and then quickly move the brush into a storage bucket. This can result in some liquid being splashed or dripped on the floor. In any event, a storage place for the brush is needed between uses where drippings can collect.

The art therefore designed toilet brushes where permanent brush handles were provided, but the brush heads were formed as disposable and replaceable elements. See e.g. U.S. Pat. Nos. 2,755,497, 4,031,673, 5,630,243, and 6,094,771. See also GB 2,329,325. These brushes were designed so that a small replaceable head could be flushed down the toilet after each use. Some such heads were impregnated with a cleaning composition to avoid the need to separately add a cleaning chemical.

However, certain types of such brush heads could cause clogging problems, or be otherwise unsuitable for use with sensitive septic, sewer or connecting piping systems. This might be due to the size of the head, or to extra structures (such as cardboard bands) used to hold head parts together, or to the nature of adhesives that held the head together.

In other prior art devices, some formed their disposable brush heads from highly water-degradable material. Unfortunately, the material they chose sometimes would begin to fall apart before the cleaning process was completed, particularly when aggressive scrubbing was attempted. Further, such material was so flexible that it made it difficult to transmit scrubbing force from the handle to the brush head portion without risking the handle scratching the bowl sides.

Other devices of this type could not be produced efficiently with automated equipment. With those, the cost of the devices was such as to make them less competitive in the marketplace.

In GB 2,329,325 there was disclosed a toilet brush having their brushing portion formed of a stack of bound sheets of water-dissolvable material. However, that structure used water dissolvable adhesive to bind the stack together. This was relatively costly to implement and slowed the process of degradation of the brush head once it left the toilet.

Thus, a need continued to exist for improved replaceable brush heads for use with toilet brush wands and the like.

SUMMARY OF THE INVENTION

In one aspect the invention provides a brush head suitable to be held by a cleaning device. Such a brush head can have a plurality of layers of a material positioned on top of each other in the form of a stack of such layers. The stack has a compressed region and at least one of an upper or lower surface of the compressed region has an indentation. Further, at least one of the layers has been pierced at the indentation to interlock that layer with another layer of the stack.

In preferred forms the material is a water-degradable material, the compressed region is adjacent a rearward end of the stack, and a plurality of the layers are formed with bristle segments adjacent a forward end of the stack. The brush head is for a cleaning implement intended for use in cleaning a plumbing fixture, such as a brush head for a toilet brush.

In another form the invention provides a brush head suitable to be held by a cleaning device. That brush head has a plurality of layers of a water-degradable material positioned on top of each other in the form of a stack of such layers, and a compressed region adjacent (e.g. extending from) its rearward end. At least one of an upper or lower surface of the compressed region has an indentation, and at least one of the layers has been pierced at the indentation to interlock that layer with another layer of the stack.

In yet another form, the invention provides a toilet brush having a handle with a clamping jaw and such a brush head.

The brush head may be held by a variety of different wands or other holding mechanisms. It is most preferred to clamp the head with a clamping mechanism such as one disclosed in our assignee's U.S. patent application Ser. No. 10/615,178, filed on Jul. 8, 2003. That application also discloses a variety of brush heads made from stacked layers of water-degradable material, albeit without the use of the indentation feature.

Still other types of holders could be used with this type of brush head. See e.g. U.S. Pat. Nos. 245,585 and 1,631,791.

Water-degradability is a desirable feature because it allows the head to be flushed immediately after use, thereby avoiding the need to transport the dripping head to a garbage can, and avoiding any odors that may develop if the brush head were left in a garbage can for some time period after use. Preferred water-degradability exists where with the degree of mechanical action typical in residential plumbing systems, the material will structurally separate in water into numerous small pieces in a short period.

For purposes of interpreting our claims, we use a standard laboratory test, rather than observing the particular material in a plumbing facility. In this regard, we agitate a standard sample of the material in a tube containing water, by repetitively inverting the tube at a standard speed.

We obtain a transparent tube (e.g. a plastic tube) that is 500 mm in height with an internal diameter of 73 mm. We place in the tube 700 ml of tap water at 23° C. A 100 mm×100 mm sample of the material to be tested (regardless of thickness) is placed in the water and allowed to stand immersed for 30 seconds. During the 30 seconds the tube is stoppered.

The tube is then inverted (rotated 180 degrees), stopped for a second, turned back to the original starting position (180 degrees), and then stopped for a second. Note the reversal of direction, rather than continued rotation in the same direction which might create a centrifugal force which forces the material to a wall. Each cycle takes about four seconds, leading to an average test speed of 15 such cycles per minute.

We then examine whether within five minutes of such agitation the material has at least split into two pieces. If so, the material is considered "water-degradable" for purposes of our claims. Note that it is highly preferred that the material be chosen so that under these conditions, within that five minutes, the material will have broken up into many small pieces. Note that "water-degradable" is not being used in this application in a way that necessarily requires any particular degree of biodegradability (as distinguished from structural degradability under the conditions specified). Of course, for a variety of reasons, biodegradability may well be desirable as well.

While a variety of cellulosic materials have been developed for use as toilet paper, and most toilet papers are water-degradable, stacked plies of conventional toilet paper would not be optimal for these brush heads as such paper is typically designed to degrade much more quickly than desired when used for cleaning bowl sides. It is instead preferred to use a nonwoven fibrous web formed from a blend of cellulosic fibers that are hydroentangled. See U.S. Pat. No. 4,755,421 for a disclosure of such hydroentangled materials.

It is most preferred to use a nonfibrous web which is at least 70% pulp fibers hydroentangled with other selected fibers. Suitable materials are available from Ahlstrom Corporation under the tradenames Hydraspun 784 Flushable Wipes, Hydraspun 8553 Flushable Wipes, Hydraspun 1280 Flushable Wipes, and Hydraspun 1280 Flushable Wipes Apertured Grade. The last of these materials is a somewhat more abrasive material than the other three.

One could one start with a material having a dry thickness of about 500 microns. By forming a two-ply structure of that material one could end up with a thickness of about 1,000 microns.

The brush heads of the present invention could be formed from a single piece of water-degradable material that has been repetitively folded back on itself in accordion fashion. This is one form of a "stack" of material.

Another approach is to take shorter segments of that material, fold them over once (or not al all), and then stack the segments. Either approach creates a stacked brush head.

In any event, it is preferred to have between four and forty layers of such material in the stack. Using less than four layers may provide too small a brush head (which takes longer to clean a typical toilet bowl), or require each sheet to be so thick as to be less degradable. Using more than forty layers increases the production cost and (depending on the thickness of the layers) may increase the frequency of clogging the toilet or problems in the septic system. To achieve any desired level of thickness of a particular layer, one can start with a sheet that is already that thick, or take multiple sheets of less thickness and (by pressing) create a multiple ply layer.

It is preferred that the rear end be compressed such that at rest the bristle front end will be between 50 and 200% thicker than the part with undulations. When this is the case, the bristle end will tend to spread out/flower an appropriate amount when pushed against the bowl side during a scrubbing motion.

It is also preferred for the compressed section to constitute no more than one-half of the head axial length. This permits at least one-half of the length to be used for bristles and spreading thereof.

In some forms the brush head will be at least partially impregnated with a cleaning chemical such as a surfactant. The chemical might be a mixture of one or more of surfactants known to be effective for toilet bowl or other cleaning (for example most preferably anionic and nonionic in combination, but also possible cationic or zwitterionic). The chemical composition can also include fragrance, dye (for example to dye the head itself or for turning the bowl water a desired color such as blue), preservatives, bleaches, and/or other additives conventional in toilet bowl cleaners (for example abrasives).

Most preferably, any such impregnating chemical will only have a very low percentage, or no, water. For example, the chemical composition could, as applied, have less than 30% water. By using low levels of (or no) water in the cleaning chemical, the cleaner is inhibited from migrating during storage from the interior layers to the exterior layers. Further, the structural integrity of the brush is protected.

The stack is preferably cut with a series of parallel cuts at the forward end, to create bristles. Each bristle could be single-layered, or more preferably be at least a double-layered structure in the form of a loop.

From the following description it will be understood that the present invention advantageously provides in various embodiments a brush head of the above kind that:

(a) have relatively stiff rearward portions such that force applied to the rear of the brush heads via the brush handles will be efficiently transmitted to the bristles of the brush heads to assist scrubbing;

(b) can easily be securely mounted in a jaw of a holding wand;

(c) can be manufactured using automatic equipment; and (d) which resist disassembly prior to use, but readily separate in sewer or septic systems.

These and still other advantages of the present invention will be apparent from the following disclosure. In the following description reference is also made to the accompanying drawings which form a part thereof, and in which there is shown by way of illustration preferred embodiments of the invention. These embodiments do not represent the full scope of the invention. Rather, reference should be made to the claims herein for determining the full scope of the invention.

DETAILED DESCRIPTION OF THE INVENTION

Figure 1:
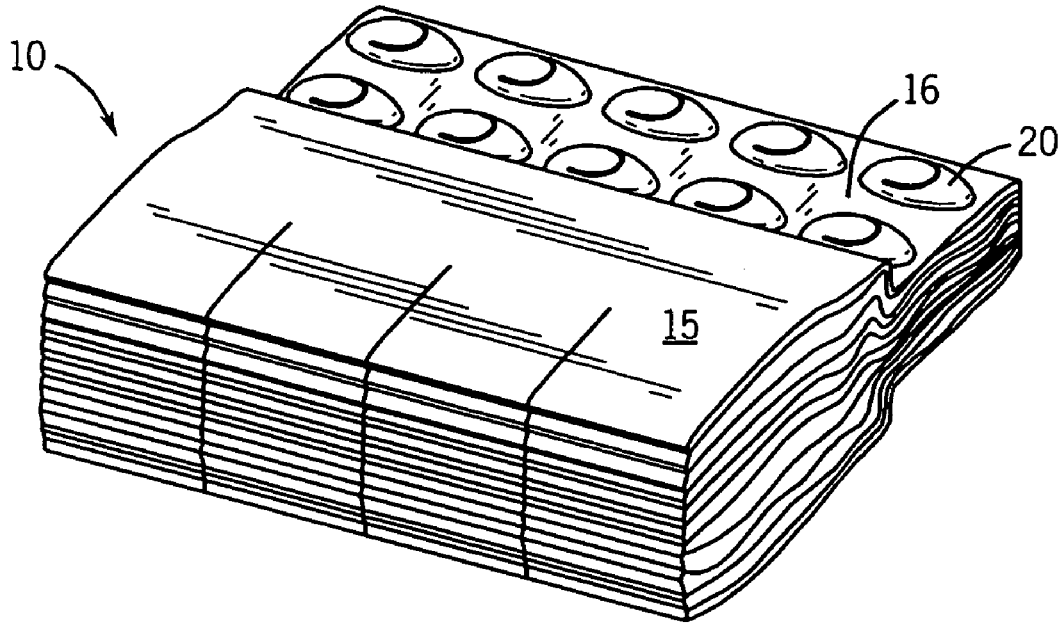
FIG. 1 is a right, top, front perspective view of a brush head embodying our new design.
Figure 2:
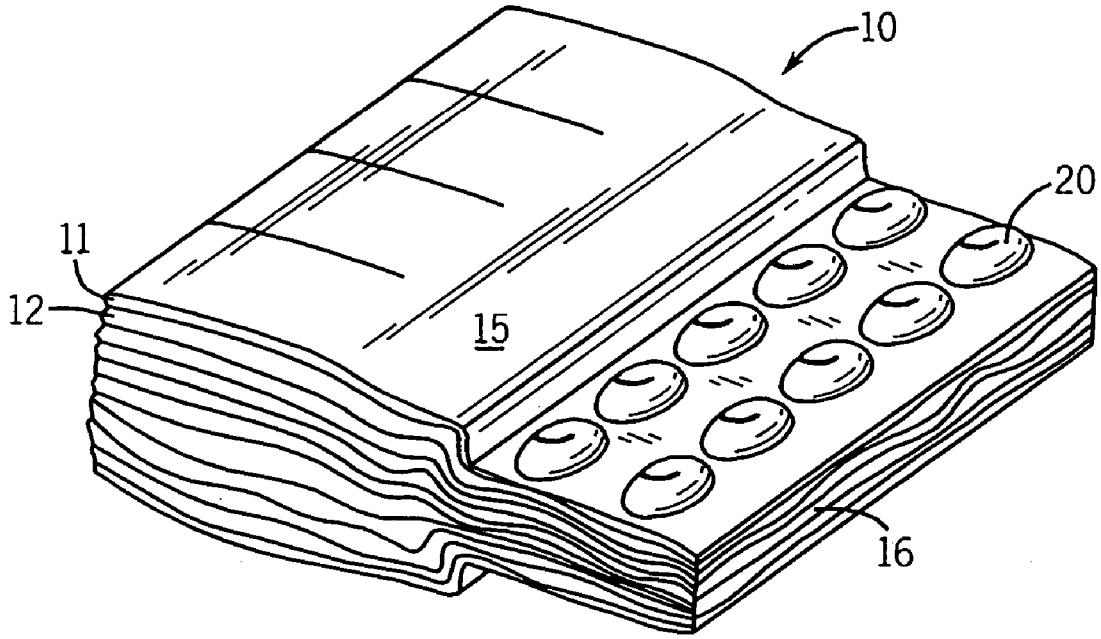
FIG. 2 is a right, top, rear perspective view thereof.

As seen in FIGS. 1 and 2, the invention relates to a brush head 10 formed from a stack of layers 11, 12, etc., of water-degradable material. The layers are folded back on each other once, and then stacked. The closed end of each layer is the forward end.

The brush head has a forward brushing portion 15 and a rearward compressed region 16. Compression rollers can be used to compress this region in an automated fashion. Such compression serves to bind the rearward end of the stack together by a type of mechanical quilting. However, if this all the binding that was done there would be some risk that a consumer might break the layers away from each other prior to use.

Figure 3:
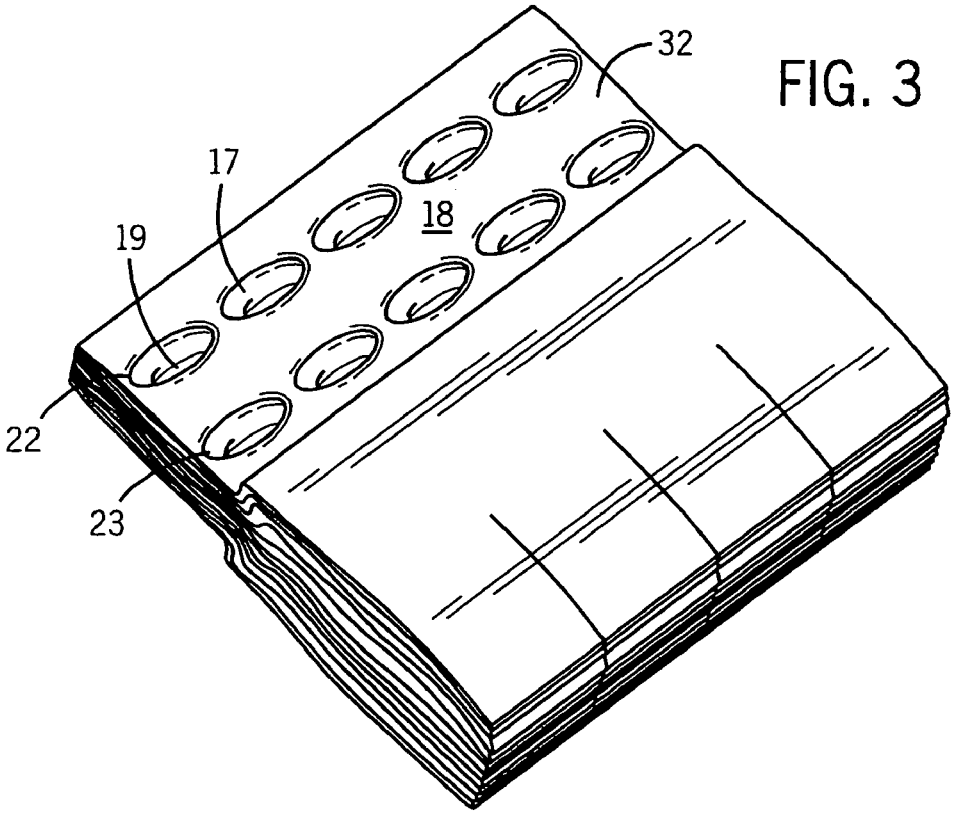
FIG. 3 is a right, bottom, front perspective view thereof.
Figure 4:
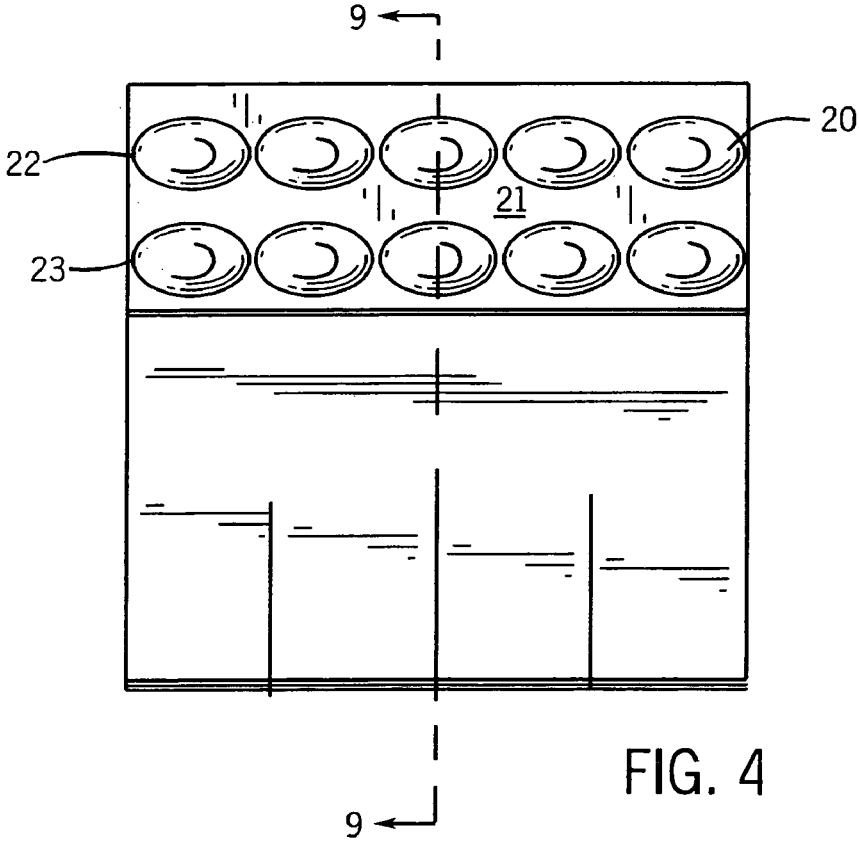
FIG. 4 is a top plan view thereof.
Figure 5:
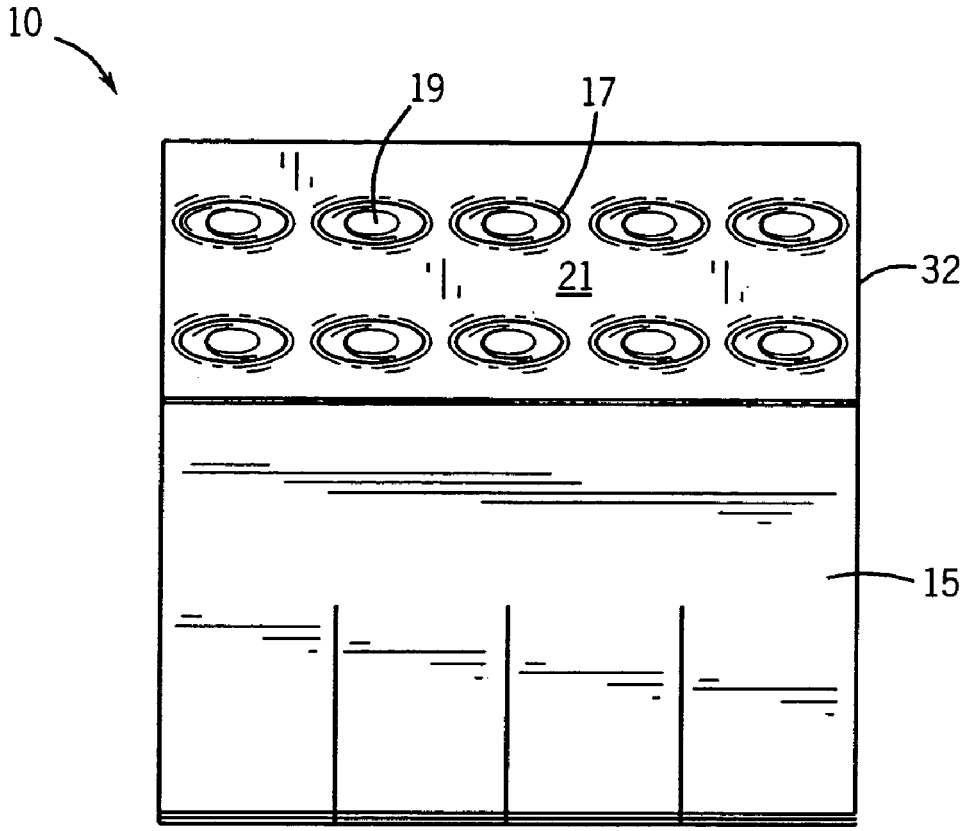
FIG. 5 is a bottom plan view thereof.
Figure 6:
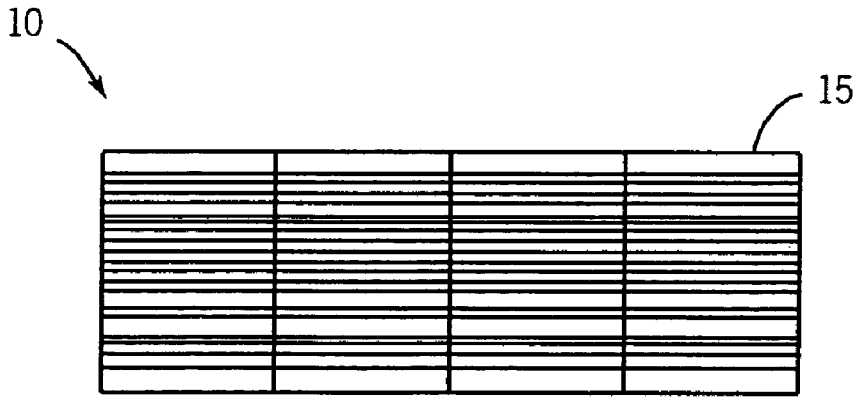
FIG. 6 is a front elevational view thereof.
Figure 7:
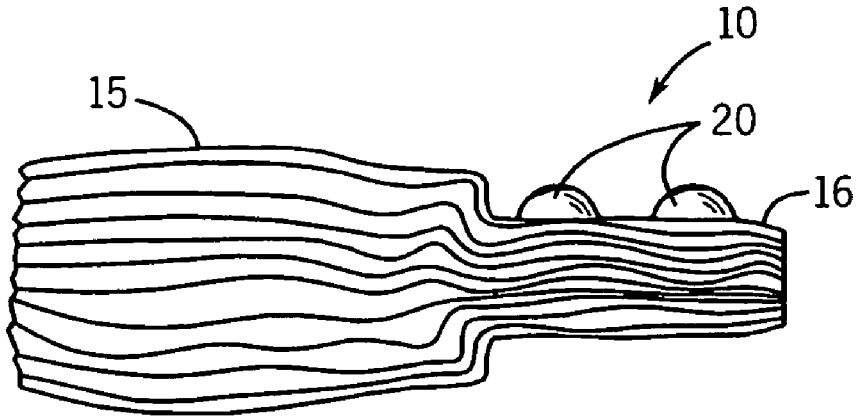
FIG. 7 is a right side elevational view thereof, the left side elevational view thereof being a mirror image thereof.
Figure 8:
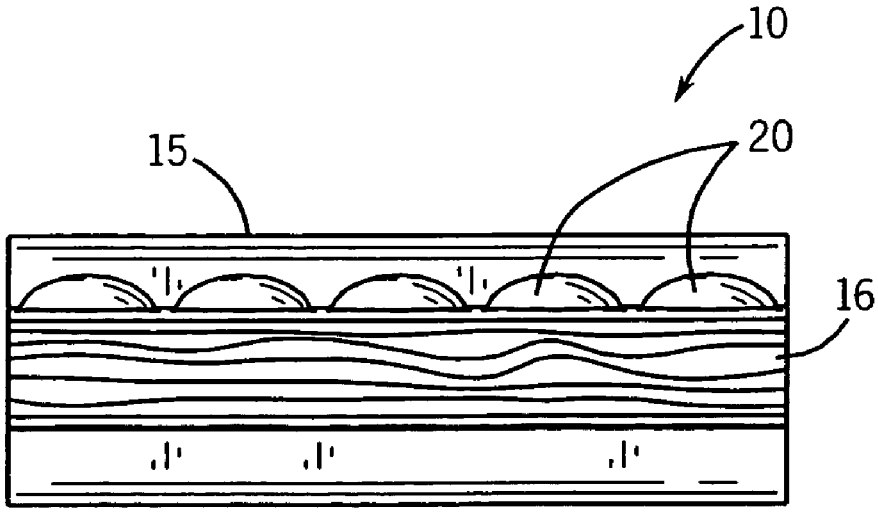
FIG. 8 is a rear elevational view thereof.
Figure 9:
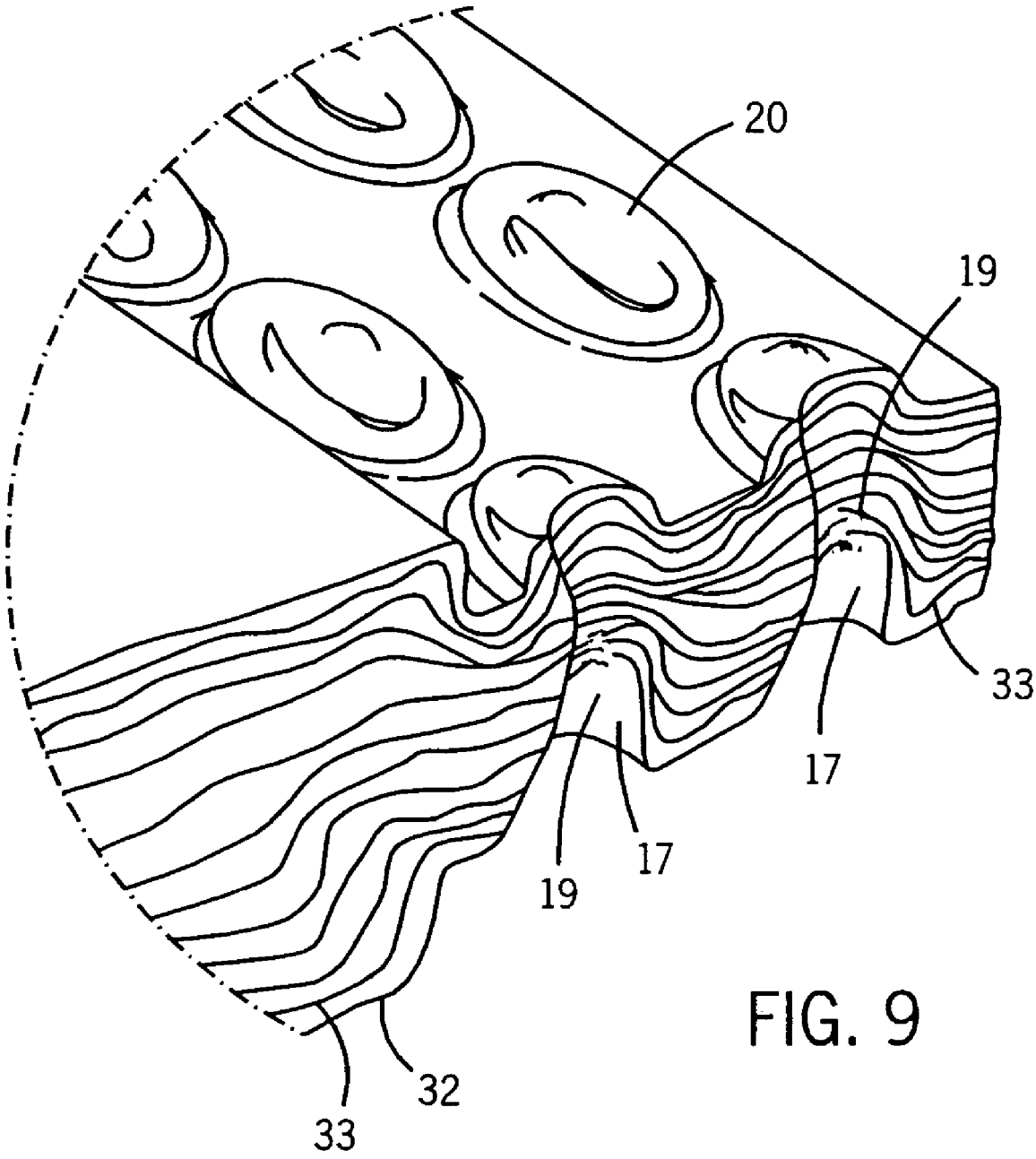
FIG. 9 is a detailed, enlarged right, front, top perspective view of a portion of the brush head, after the brush head has been cut along 9-9 of FIG. 4.

Thus, as depicted on FIG. 3, we also form a series of indentations 17 on the lower surface 18 of the region 16. The center of each indentation has a pierced portion 19.

In one form, the same force that creates the piercing and indentations can form bumps 20 along upper surface 21 of the compressed region 16. The bumps and indentations are preferably in two rows 22 and 23, and each bump may be aligned with an indentation.

Preferably, both the indentations and bumps are generally oval. The bumps are a result of a certain degree of pressure at the bottom of the brush head, but may also have an advantage in providing for easier gripping by a clamp jaw. In any event, the indentations and piercing assist in bonding the layers together.

A preferred way to form the indentations and bumps is to roll a second roller over the lower surface of the compressed region 16, in a transverse direction. This roller could have spaced raised oval elements with sharp outer points. The rolling action forms the indentation while simultaneously breaking at least the outer lower layer 32, so that the outer layer passes through the main plane 33 of the next adjacent layer. This forms an interlock. Depending on the number of layers pierced, still further interlocking of layers can take place.

It should be appreciated that the exact form of the indentations (or bumps) is not critical. For example, the plan view of both can be square, circular or of other shape. Further, the bumps need not be present at all. Thus, the invention is not to be limited to the specific embodiments shown. Rather, the claims should be looked to in order to judge the full scope of the invention.

INDUSTRIAL APPLICABILITY

Brush heads are provided for use with cleaning implements such as toilet brushes.

We claim:

1. A toilet brush head suitable to be held by a toilet cleaning device, wherein the brush head comprises:

a plurality of layers of a material positioned on top of each other in the form of a stack of such layers;

wherein each layer is formed from at least one sheet of the material which has been folded back on itself along a fold line to create a loop, the fold line being positioned on a forward end of the stack;

wherein the stack has between four and forty layers;

wherein one such loop has three essentially parallel cut structures extending from a forward end, wherein the cut structures define a plurality of bristle segments of the one such loop adjacent a forward end of the one such loop;

wherein the stack has a compressed region adjacent a rearward end of the stack;

wherein at least one of an upper or lower surface of the compressed region has an indentation; and wherein at least one of the layers has been pierced at the indentation to, by virtue of the piercing, interlock that layer with another layer of the stack;

whereby the interlocked layers are held together by the interlock sufficiently to resist disassembly from each other prior to use, but the brush head is still configured to be able to separate into pieces in a sewer or septic system after use; and wherein the forward end of the stack is configured so as to be able to spread out/flower as the forward end of the brush head is pushed against a toilet bowl surface during a scrubbing motion.

2. The brush head of claim 1, wherein the material is a water-degradable material.

3. A toilet brush comprising:

a handle having a clamping jaw; and the brush head of claim 1.

* * * * *

UNITED STATES PATENT AND TRADEMARK OFFICE

CERTIFICATE OF CORRECTION

PATENT NO. : 7,650,663 B2
APPLICATION NO. : 10/975603
DATED : January 26, 2010
INVENTOR(S) : Michaels et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 760 days.

Signed and Sealed this

Twenty-third Day of November, 2010

David J. Kappos

David J. Kappos
*Director of the United States Patent and Trademark Office*